US010583979B2

(12) United States Patent
Schmidt-Ellinger

(10) Patent No.: US 10,583,979 B2
(45) Date of Patent: Mar. 10, 2020

(54) STORAGE CONTAINER FOR DRUG DISPENSING AND STORAGE STATIONS

(71) Applicant: CareFusion Germany 326 GmbH, Kelberg (DE)

(72) Inventor: Hardy Schmidt-Ellinger, Gerolstein-Bewingen (DE)

(73) Assignee: CAREFUSION GERMANY 326 GMBH, Kelberg (DE)

( * ) Notice: Subject to any disclaimer, the term of this patent is extended or adjusted under 35 U.S.C. 154(b) by 0 days.

(21) Appl. No.: 14/880,448

(22) Filed: Oct. 12, 2015

(65) Prior Publication Data

US 2017/0101255 A1 Apr. 13, 2017

(51) Int. Cl.
*B65D 83/04* (2006.01)
*A61J 7/00* (2006.01)

(52) U.S. Cl.
CPC ..... *B65D 83/0409* (2013.01); *A61J 7/0076* (2013.01); *A61J 7/0084* (2013.01)

(58) Field of Classification Search
CPC ..... A61J 7/0076; B65D 83/0409; G07F 11/0092; G07F 11/005; G07F 11/24
See application file for complete search history.

(56) References Cited

U.S. PATENT DOCUMENTS 3,128,011 A * 4/1964 Bleiman ..... G07F 11/44 221/154
3,362,578 A * 1/1968 Spencer ..... B65D 83/0472 221/25
3,817,423 A * 6/1974 McKnight ..... B65B 35/56 198/392
4,903,861 A * 2/1990 Yuyama ..... B65G 47/1457 221/265
5,219,095 A * 6/1993 Shimizu ..... G07F 17/0092 221/264

(Continued)

FOREIGN PATENT DOCUMENTS

CA 2916201 A1 * 1/2015 ..... B65B 35/08
CN 1543415 A 11/2004

(Continued)

OTHER PUBLICATIONS

European Search Report dated Jan. 27, 2016 in EP 15 18 93 06 (8 pages).

(Continued)

*Primary Examiner* — Gene O Crawford
*Assistant Examiner* — Kelvin L Randall, Jr.
(74) *Attorney, Agent, or Firm* — Morgan, Lewis & Bockius LLP

(57) ABSTRACT

A storage container for a storage and dispensing station for drugs is provided. The storage container includes a housing enclosing a receiving space, a circular-cylindrical section and a bottom area having a discharge opening. A singling device situated in the circular-cylindrical portion of the housing includes at least one duct and a restrainer completely situated within the housing enclosing the receiving space. The restrainer includes a fastening portion and a restraining portion. The restraining portion is kept above the discharge opening and the fastening portion works together with at least one fastening socket within the housing to fix the restrainer in the housing.

16 Claims, 4 Drawing Sheets

(56) References Cited

U.S. PATENT DOCUMENTS 5,787,678 A 8/1998 Koike et al.
5,803,309 A * 9/1998 Yuyama ..... G07F 17/0092 221/27
5,865,342 A * 2/1999 Ito ..... G07F 17/0092 198/691
6,394,308 B1 * 5/2002 Yuyama ..... B65G 47/1457 221/119
8,616,409 B2 * 12/2013 Young ..... B65G 47/1457 221/167
9,181,017 B2 * 11/2015 Bae ..... A61J 7/0084
9,663,260 B2 * 5/2017 Morita ..... B65B 35/08
2003/0057231 A1 3/2003 Kim
2003/0074868 A1 * 4/2003 Yasuoka ..... B65B 5/103 53/493
2004/0195261 A1 10/2004 Hashimoto
2007/0145066 A1 * 6/2007 Knoth ..... G07F 11/44 221/265
2007/0150092 A1 * 6/2007 Ohmura ..... G06F 19/3462 700/231
2008/0099499 A1 * 5/2008 Kim ..... G07F 11/54 221/82
2013/0233894 A1 * 9/2013 Kim ..... A61J 1/03 222/370
2013/0240555 A1 9/2013 Kim
2014/0339252 A1 * 11/2014 Bae ..... G07F 17/0092 221/277
2015/0028078 A1 * 1/2015 Yuyama ..... G07F 11/66 225/1
2016/0371916 A1 * 12/2016 Omura ..... B65B 35/08

FOREIGN PATENT DOCUMENTS

CN 103228244 A 7/2013
WO WO 2013/034504 3/2013

OTHER PUBLICATIONS

English Translation of the International Preliminary Report on Patentability for Application No. PCT/EP2016/070868, dated Apr. 17, 2018, 6 pages.
Chinese Office Action for Application No. 201680059565.4, dated Aug. 7, 2019, 8 pages.

* cited by examiner

STORAGE CONTAINER FOR DRUG DISPENSING AND STORAGE STATIONS

BACKGROUND

The present disclosure relates to a storage container and, in particular, a storage container of a drug dispensing and storage station.

Modern automated blistering machines, for example, those disclosed in the publication WO 2013/034504 A1, include, depending on the level of configuration, several hundred storage and dispensing stations. These storage and dispensing stations store a plurality of drug portions of a specific drug and, upon request, individual drug portions may be dispensed. Using the automated blistering machines, the drug portions stored in the storage and dispensing stations are combined and blistered individually for each patient according to the medically prescribed input time points.

In many medical treatment settings, it is desirable to provide a storage container for the storage and dispensing station that minimizes the contamination of the automatic blistering machine in which the storage and dispensing station is used.

SUMMARY

One or more disclosed embodiments provide a storage container for drug storage and dispensing stations. The storage container includes a housing defining a receiving space for drug portions, the housing having a circular-cylindrical section and a bottom area having a discharge opening. The storage container also includes a singling device situated in the circular-cylindrical section of the housing, the singling device having at least one duct for receiving at least one drug portion. The storage container further includes a restrainer disposed completely inside of the housing. The restrainer includes a fastening portion and a restraining portion, the restraining portion positioned above the discharge opening. The restraining portion prevents additional drug portions from the receiving space from entering the at least one duct aligned with the discharge opening. The fastening portion of the restrainer works together with at least one fastening socket within the housing to fix the restrainer in the housing.

One or more disclosed embodiments provide a storage container assembly including a housing. The housing includes a receiving space for storing one or more drug portions, a circular-cylindrical section, a discharge opening and a fastening socket. The storage container assembly also includes a singling assembly disposed in the circular-cylindrical section and having a duct. The storage container assembly further includes a restraining assembly. The restraining assembly includes a fastening portion configured to engage with the fastening socket to secure the restraining assembly and a restraining portion configured to prevent the one or more drug portions from entering the duct when the duct is aligned with the discharge opening.

One or more disclosed embodiments provide a storage container assembly of a storage and dispensing station for medications that includes a housing. The housing includes a receiving space for storing a plurality of the same type of medication, wherein the medication is one of pills, tablets, capsules and gel-caps, a circular-cylindrical section, a discharge opening disposed at the bottom of the circular-cylindrical section and first and second fastening sockets. The storage container assembly also includes a singling assembly disposed in the circular-cylindrical section and having a plurality of ducts. The storage container assembly further includes a restraining assembly that includes first and second fastening portions slidingly engaged with the first and second fastening sockets respectively to secure the restraining assembly to the housing. The restraining assembly also includes a restraining portion disposed over the discharge opening and configured to prevent any medication from entering a duct aligned with the discharge opening.

BRIEF DESCRIPTION OF THE DRAWINGS

The device according to the present disclosure and the method according to the present disclosure are described in greater detail below, with reference to the appended drawings, wherein.

DETAILED DESCRIPTION

Figure 1B:
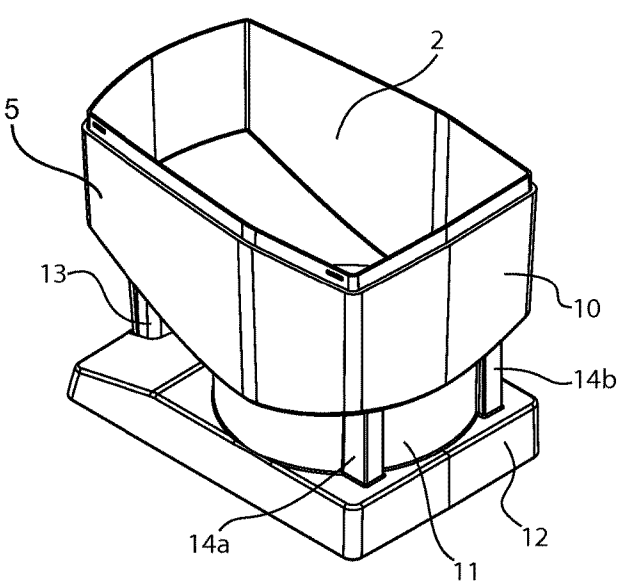
FIG. 1B is a rear perspective view of the storage container of FIG. 1A.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

In order to package drug portions or medications, typically respective storage and dispensing stations are actuated for dispensing one or a plurality of individual drug portions. When actuating a storage and dispensing station, a singling device separates an individual drug portion, which is transferred via a discharge opening to a guiding device of an automatic blistering machine. The drug portions or medications stored in a particular storage and dispensing station may be the same type of medication, such as pills, tablets, capsules, gel-caps and the like. For example, one storage and dispensing station may store and dispense hexagonal shaped pain relief tablets having a first size, while another storage and dispensing station may store and dispense cylindrical acid reducing gel-caps having a second size. Using the guiding device, a dispensed drug portion is, if applicable, by inter-positioning a collecting device, fed into a packaging device, which blister-packs individual or a plurality of drug portions according to medical specifications.

In order to individualize the drug portions that are stored in a storage container of a storage and dispensing station, the singling device includes a rotor having a plurality of ducts, which conventionally are situated at the outer circumference of the rotor. The ducts are, with regard to their dimensions, adapted to the respective drug portions to be separated in such a manner that the drug portions in a duct may be situated only above one another, but not next to one another.

In order to dispense a drug portion from a duct, a duct is moved above a discharge opening in the housing of the storage container, and the drug portion disposed at the undermost location in the duct slides or drops into the discharge opening. In order to avoid additional drug portions stored in or above the duct being dispensed as well, a restraining portion of a restrainer in the area above the discharge opening is guided at least into or above the duct that is aligned with the discharge opening. This restraining portion is, in relation to the height of the duct, situated in or above said duct in such a manner that only one drug portion may be disposed below the restraining portion. In case the restraining portion is guided into the duct for separating the undermost drug portion from drug portions located above it, the projections separating the individual ducts have a slot, which receives the restraining portion when rotating the rotor. In case the restraining portion is guided above the duct, the restraining portion is regularly only slightly guided above the upper end of the projections to avoid additional drug portions entering the duct when dispensing the drug portion.

In known storage and dispensing stations, a restrainer is guided from the outside through a housing slit into the storage container. Thus, dust generated when operating a storage and dispensing station may exit through the slit into the storage container and contaminate the automatic blistering machine.

According to the present disclosure, the storage container for a storage and dispensing station for drugs may include a housing enclosing a receiving space for drug portions, the housing having a section in the shape of a circular cylinder and a bottom area, the bottom area having a discharge opening for receiving single drug portions.

In a circular-cylindrical section of the housing, a singling device having at least one duct for receiving at least one drug portion is provided. The duct may, as a function of the precise design of the singling device, receive only one drug portion or a plurality of drug portions, and these drug portions then may only be located above one another.

Furthermore, the storage container includes a restrainer or restraining assembly located completely inside the housing, the housing enclosing the receiving space, and having a fastening portion and a restraining portion. The restraining portion may be kept or positioned above the discharge opening to prevent additional drug portions from entering a duct aligned with the discharge opening. A fastening portion may work together or engage with at least one fastening socket inside the housing for fixing or securing the restrainer in the housing. For example, the fastening portion may be slidingly received within the fastening socket so that the restrainer may be removed from the housing if desired. The fastening socket may be configured to provide that the restrainer is fixedly kept in place. The design of the fastening portion of the restraining portion is also arbitrary, as long as it is provided that the restrainer itself is fixed into place in the housing. For example, the fastening portion and the restraining portion may relate to the same component of the restrainer, but may, however, have different functions.

Due to the refinements of the present disclosure and the positioning of the restrainer, the insertion of a slot, through which the restraining portion is guided into the housing, may be omitted. Thus, dust generated when operating the storage and dispensing station may not reach the outside, but rather the dust to a great extent remains in the interior of the storage and dispensing station and may there be collected before a possible discharge to the outside.

As a function of the precise refinement of the at least one duct for receiving drug portions, the restraining portion may be situated above an upper opening of the duct aligned with the receiving space. In this case, the duct is spatially designed or configured such that only one drug portion is able to be situated in the duct. In case the duct is designed such that a plurality of drug portions may be situated above one another, the restraining portion of the restrainer is guided into the duct aligned with the discharge opening such that the drug portions situated in the duct are separated and, that is, at least one drug portion is situated above the restraining portion and exactly one drug portion below the restraining portion. The drug portion situated below the restraining portion is dispensed via the discharge opening. Additional drug portions entering the duct are, however, prevented because only the bottom drug portion is dispensed and the restrainer prevents additional drug portions from sliding through, thereby preventing the entry of additional drug portions. In such a refinement, the projections of the singling device defining the ducts have a slot in which the restraining portion is provided or disposed.

Independent of which type of duct is used, it is always necessary to adapt the positioning of the restraining portion to above or in the duct and the design of the duct itself to the size of the drug portions. In known storage and dispensing stations, this is achieved by adapting singling devices to the drug portions (e.g., configuring the duct) and adapting housings (e.g., positioning the slot or restraining portion). Thus, a plurality of different restrainers, singling devices and housings are typically required. Owing to the displacement of the restrainer completely into the housing, the storage and dispensing station according to the present disclosure advantageously eliminates the need to have a plurality of housings.

In order to also avoid using different restrainers adapted to the configuration of the at least one duct, a preferred embodiment provides that the at least one fastening portion of the restrainer works together with the restraining portion within the housing in such a manner that the restraining portion of the restrainer may be fixed in a height-adjustable manner.

In order to fix the restrainer, the fastening section of the restrainer works together with at least one fastening socket within the housing. The fastening socket may be situated at any point within the housing, and the location of the fastening socket determines the precise refinement of the restrainer and, in particular, of the fastening portion of the restrainer. In a preferred embodiment, in which the restrainer is embodied in a particularly simple manner, it is provided that at least one fastening socket is disposed at the circular-cylindrical section of the housing. A singling device is also disposed in the circular-cylindrical section of the housing, in which ducts or above which ducts the restraining portion of the fastener are fixed, so that this spatial arrangement of the fastening socket architecturally enables a particularly simple restrainer.

As already illustrated above, it is provided that in a preferred embodiment the restraining portion of the restrainer may be fixed in a height-adjustable manner. In order to achieve this object, it is contemplated to provide different fastening settings for the fastening socket, by which settings the fastening portion of the restrainer may work together with the fastening socket. The different fastening settings may, for example, be realized by a catch or the like, which, as a function of the precise refinement of the ducts, positions the restraining portion.

One or more embodiments provide that the at least one fastening socket has a cylindrical cavity and the fastening portion has at least a cylindrical guiding portion. Here, the cylindrical guiding portion is situated in the cylindrical cavity of the fastening socket and the cylindrical cavity is preferably of equal depth or deeper than the length of the cylindrical guiding portion. This provides the encompassing flexibility in regard to the height adjustability of the restrainer.

In order to situate or fix the restrainer in a particularly secure manner in the housing, one or more embodiments provide that the fastening portion has a two-part design and each part works together with one fastening socket. Within this context, it is particularly advantageous that both parts of the fastening portion are situated at the outer end portions of the restrainer. The resulting u-shaped restrainer may be fixed in the housing in a particularly stable and secure manner.

As already illustrated, the restraining portion of the restrainer may cover a duct aligned with the discharge opening from above or may grip into the duct, to prevent more than one drug portion being transferred into the discharge opening. A return element may be situated in the at least one fastening socket. The return element may push or pull the restrainer in the direction of the discharge opening, meaning, pushing or pulling it from above onto the upper surface of the projections situated between the ducts. In that a pressure or tension is exerted upon the restrainer, a height-adjustable restrainer may ensure that the restraining portion does not lift off from the projections separating the ducts, which would result in the drug portions sliding through.

Figure 1D:
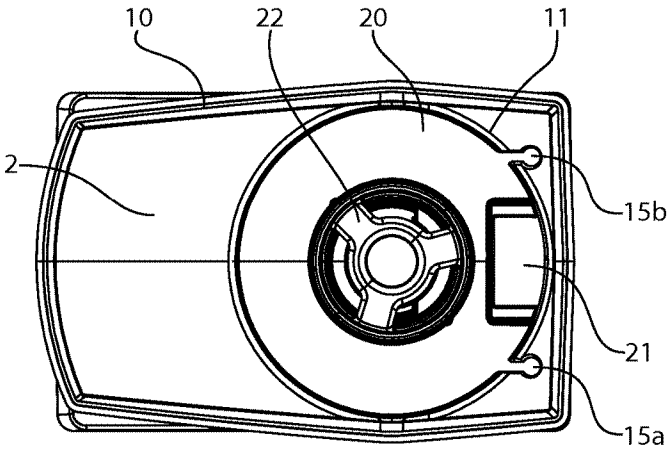
FIG. 1D is another top view of the storage container of FIG. 1A.
Figure 1A:
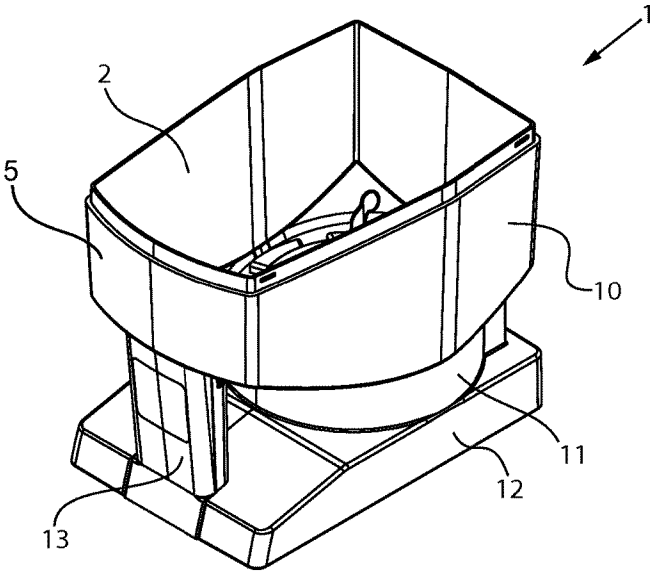
FIG. 1A is a front perspective view of an embodiment of a storage container.
Figure 1C:
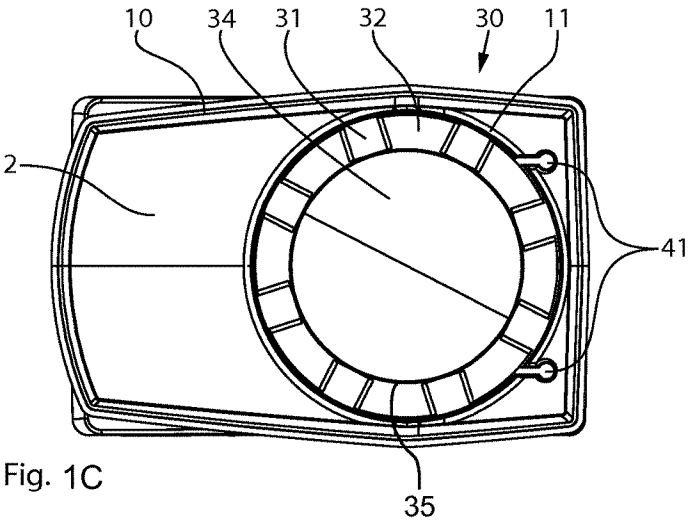
FIG. 1C is a top view of the storage container of FIG. 1A with the singling device removed.

FIGS. 1A and 1B show two perspective views of a storage and dispensing station 1 having a storage container 5. FIGS. 1C and 1D show top views of the storage and dispensing station 1, with FIG. 1D omitting a singling device 30 that is shown or implied in FIGS. 1A through 1C. In order to provide a better overview, a cover is omitted for all illustrations of the storage and dispensing station 1. A cover is typically part of a housing 10 of the storage container 5. However, a storage container 5 may also be used without a cover.

The storage container 5, according to some embodiments, may include the housing 10 enclosing a receiving space 2 for drug portions. The storage container 5 may have a circular-cylindrical portion 11 disposed on or as a bottom portion of the storage container 5. The storage container 5 and the housing 10 may be sealed on the bottom by a bottom area 20, which may have a discharge opening 21 (see FIG. 1D). The bottom area 20 may also have a central reception 22, which may work together with a singling device 30. As shown in FIG. 1C, the singling device 30 may be situated in the circular-cylindrical portion 11 of housing 10 and may include a plurality of ducts 31 for receiving at least one drug portion.

The ducts 31 may be configured by a plurality of projections 32 forming, together with a central part 34, a rotor 35, which is moved by an actuator (not shown) situated in a housing section 12. The projections 32 may be designed as one piece with the central part 34 (e.g., integral). However, it is also contemplated that the projections 32 may be attached to the outer circumference of the central part 34 and, in this way, the ducts 31 may be produced at the outer circumference of the central part 34. As can particularly be seen from FIG. 1B, the circular-cylindrical section 11 of the housing 10 may include first and second convexities 14*a*, 14*b*, in which first and second fastening sockets 15*a*, 15*b* may be formed. These features are described in more detail in subsequent figures.

In the housing section 12 situated below the storage container 5, the rotor 35 for moving the singling device 30, and additional components of the storage and dispensing station 1 may be situated or disposed. For example, a sensor for verifying the dispensing of a drug portion (not shown) may be disposed in the housing section 12. The storage container 5 may be detached from the housing section 12 (e.g., bottom portion) of the storage and dispensing station 1 to fill new drug portions into the storage container 5, for example. In order to be able to better handle the storage and dispensing station 1 or, if applicable, only the storage container 5, a handle 13 may be provided on the storage container 5, such as in a front area of the storage container 5.

As can be seen in FIG. 1D, the circular-cylindrical section 11 of housing 10 may provide, in the area of the first and second convexities 14*a*, 14*b*, the first and second fastening sockets 15*a*, 15*b*, which may extend perpendicularly cylindrically within the first and second convexities 14*a*, 14*b*. Here, the surface shell of the cylindrical fastening sockets 15*a*, 15*b* may be configured as a blind hole extending in a circular manner, and an opening may exist for the circular-cylindrical section 11 of the housing. A fastening portion 41 of a restrainer 40 may be fixed in the first and second fastening sockets 15*a*, 15*b* (see FIGS. 5 and 6).

Alternative embodiments may provide fastening sockets situated in other areas of the housing 10. For example, at an upper opening of housing 10 or at a cover (not shown in the figures illustrated).

The restrainer 40 may not protrude from the housing 10 and the circular-cylindrical section 11, and thus may be situated or disposed entirely within the housing 10 and the circular-cylindrical section 11.

Figure 2B:
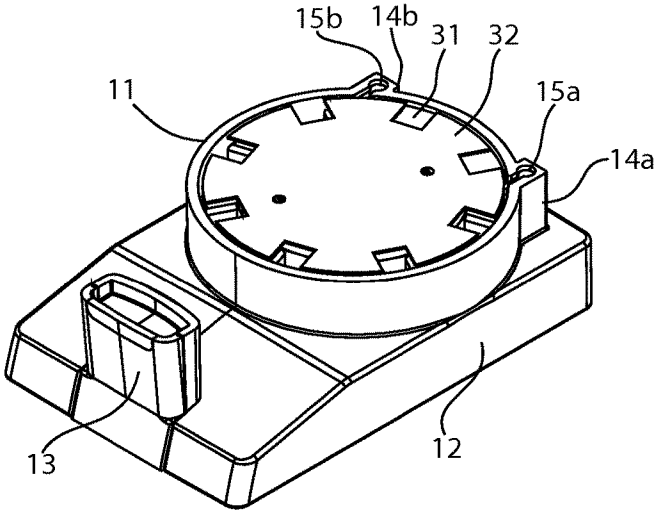
FIG. 2B is a cross-sectional view of the storage container of FIG. 1A.
Figure 2C:
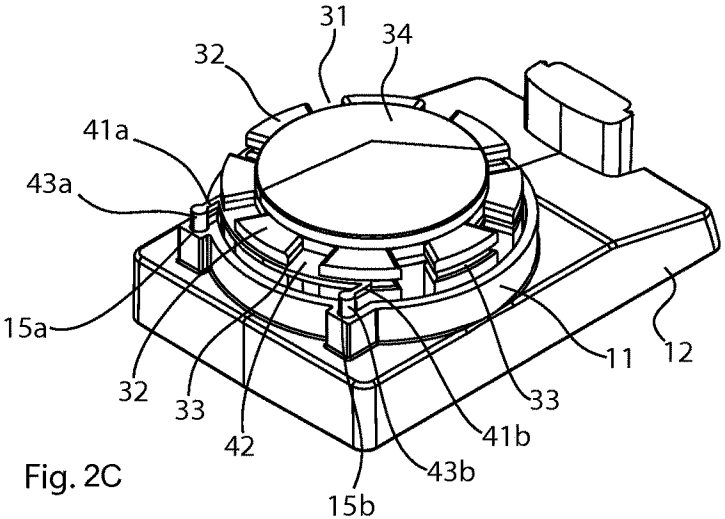
FIG. 2C is another cross-sectional view of the storage container of FIG. 1A.
Figure 2A:
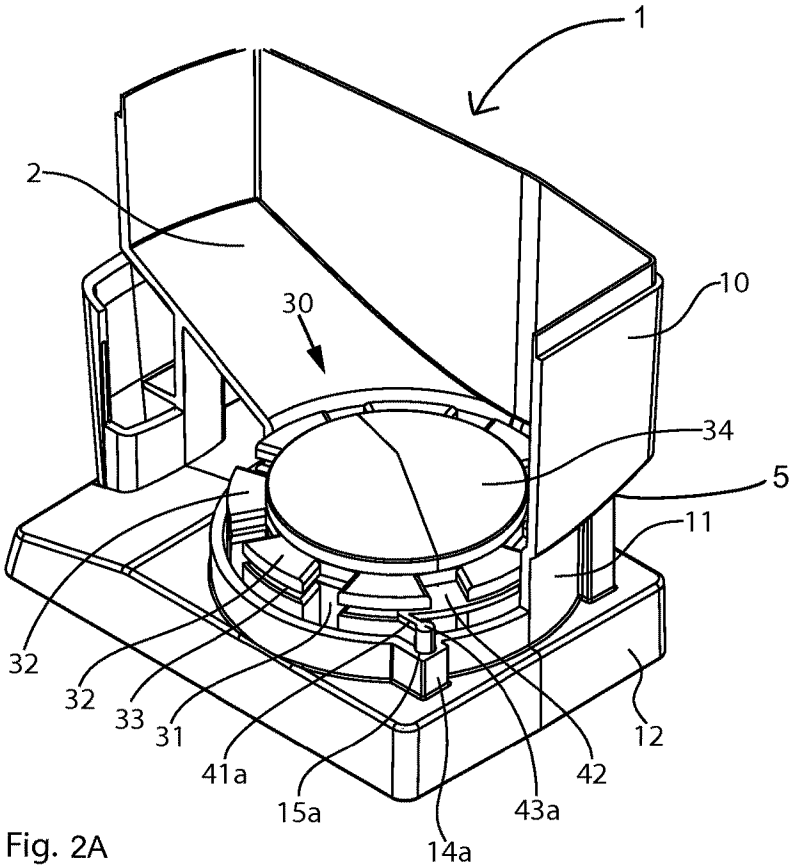
FIG. 2A is a partial cross-sectional view of the storage container of FIG. 1A.

FIG. 2A shows a partial lateral sectional view of the storage and dispensing station 1 with the storage container 5. Here, the housing 10, including the circular-cylindrical section 11, is partially cut away and the view of the central singling device 30 is clear.

The singling device 30 may include a central part 34, at which outer circumference the plurality of projections 32 may be provided. Thus, through positioning and configuration of the projections 32, a plurality of ducts 31 may be defined at the circumference of central part 34. As shown in FIG. 2A, the projections 32 are each divided at the same height as a slot 33, into which a restraining portion 42 of the restrainer 40 is guided. The first fastening socket 15*a*, into which a first circular-cylindrical portion 43*a* of a first fastening portion component 41*a* of the restrainer 40 may be guided, is formed in the first convexity 14*a* at the circular-cylindrical section 11 of the housing 10.

The special refinement of the first fastening socket 15*a* and the circular-cylindrical guiding portion 43*a* of the fastening portion component 41*a* may provide that, given that the depth of the first fastening socket 15*a* and length of the circular-cylindrical guiding portion 43*a* are appropriately selected, the restrainer 40 may be mounted in a height-adjustable manner. Thus, a restraining portion 42 of the restrainer 40 may adapt to the height of a slot 33 in the projections 32. This enables that the same restrainer 40 may be used for multiple different singling devices. Owing to the placement and fixing of the restrainer 40, it is furthermore not necessary to provide different storage containers for drugs having different dimensions, as inserting a slit into the housing 10 of the storage container 5 is no longer necessary. In known storage containers, the location for inserting a slit depends on the size of the drug portion to be stored.

FIG. 2B shows an additional sectional view that is a section through the circular-cylindrical section 11 of the housing 10 and through the singling device 30 situated in the circular-cylindrical section 11. It can be well seen from this illustration that the projections 32 may be configured in such a manner that they attach at the inner circumference of the circular-cylindrical section 11, so that a defined duct 31 may be formed between two projections 32. Furthermore, the first and second fastening sockets 15*a*, 15*b* are shown situated in the first and second convexities 14*a*, 14*b* of the circular-cylindrical section 11.

FIG. 2C shows an additional sectional view, with the housing 10 and a part of the circular-cylindrical section 11 cut away, so that the precise embodiment of the singling device 30 and its positioning in the circular-cylindrical section 11 of the housing 10 can be seen. As already described in reference to FIG. 2A, the projections 32 may each include a slot 33 for receiving a restraining portion 42 of restrainer 40. The restrainer 40 may be guided via the circular-cylindrically configured first and second guiding portions 43*a*, 43*b*, which are situated at the first and second fastening portion components 41*a*, 41*b*, into first and second fastening sockets 15*a*, 15*b* in a height-adjustable manner.

Figure 3:
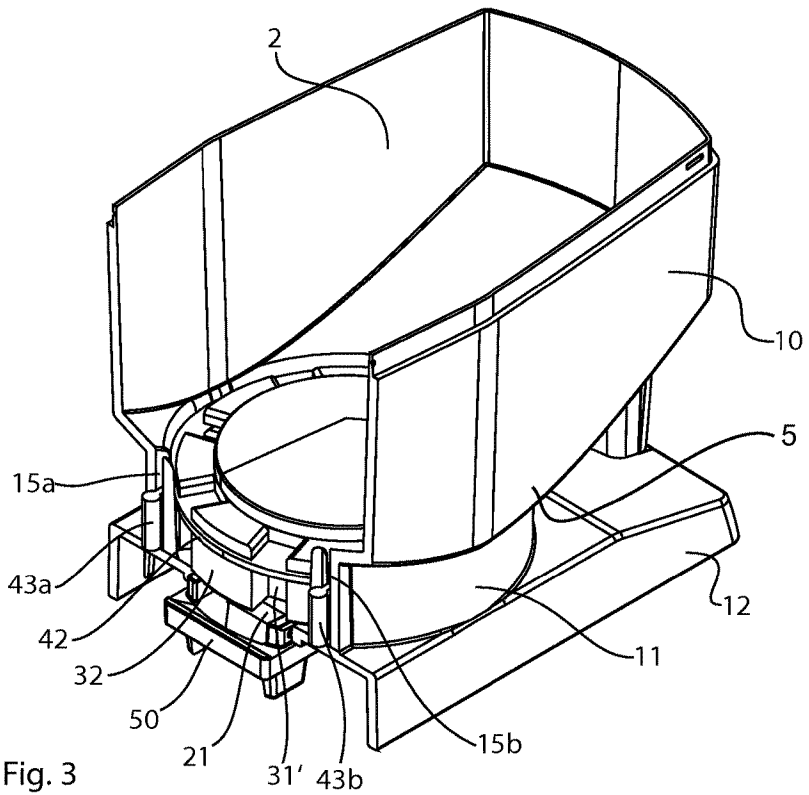
FIG. 3 is another partial cross-sectional view of the storage container of FIG. 1A.

As shown in FIG. 3, the rear section of the housing 10 having the circular-cylindrical section 11 and the bottom housing portion 12 (which is not part of the storage container 5) are cut away. In this illustration, the first and second circular-cylindrical guiding portions 43*a*, 43*b* of the first and second fastening portion components 41*a*, 41*b* of the restrainer 40 (see FIG. 6) are shown. In FIG. 3 it can be seen that below the discharge opening 21, in which a drug portion is dispensed, a guide 50 may be situated, via which the dispensed drug portion may be fed into a guidance apparatus (not shown), for example. Furthermore, it can be seen in FIG. 3 that the restraining portion 42 of the restrainer 40 is (temporarily) situated above a duct 31' aligned with the discharge opening 21.

Figure 4:
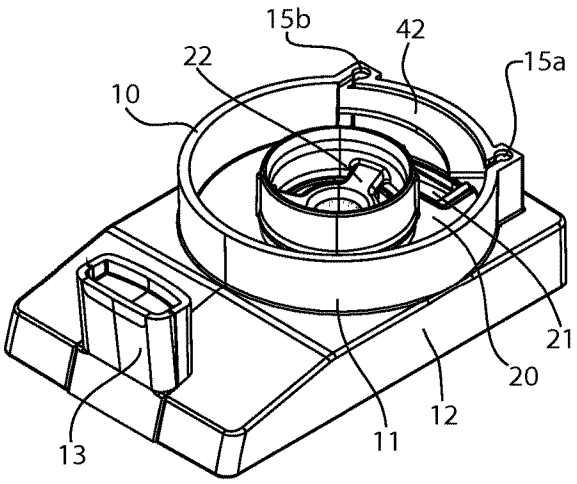
FIG. 4 is a cross-sectional view of the storage container of FIG. 1A with the singling device removed.

FIG. 4 shows a further sectional view in which the singling device 30 in the circular-cylindrical section 11 of housing 10 is omitted to illustrate the spatial arrangement of the restraining portion 42 of the restrainer 40 in the circular-cylindrical section 11. In particular, it can be seen that the restraining portion 42 may be positioned above the discharge opening 21 and, in this way, may always cover or separate the ducts 31 that are rotated above the discharge opening 21 when rotating the singling device 30. At the center of the bottom area 20, a central reception 22 for the singling device 30 is illustrated, which is configured such that the singling device 30 is rotatable by a motor (not shown) via the central reception 22.

Figure 5:
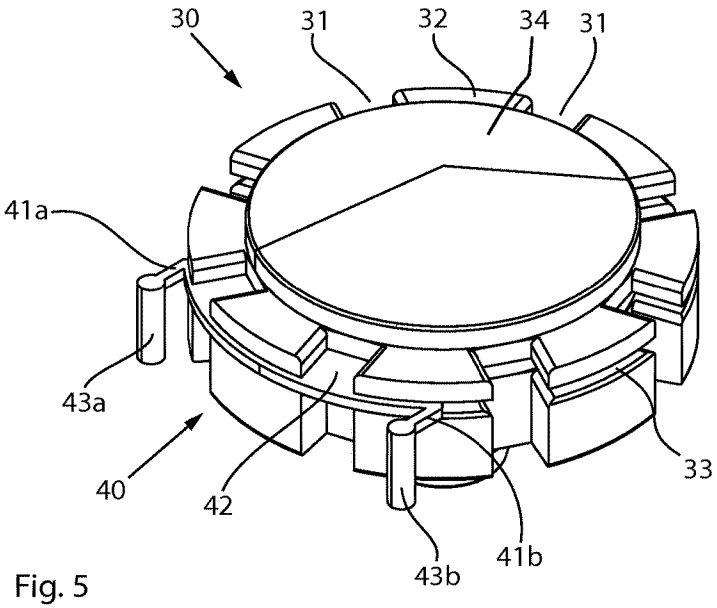
FIG. 5 is a perspective view of an embodiment of a singling device in combination with a restrainer.

FIG. 5 shows a detailed view of the interaction between the restrainer 40 and the singling device 30. As can be seen, the restraining portion 42 of the restrainer 40 is guided in the slot 33 of the projections 32 and may prevent, at both ducts 31 positioned between the first and second guiding portions 43*a*, 43*b*, a drug portion situated in the receiving space 2 above the singling device 30 from entering into the duct 31 below the restraining portion 42. In this way, a sliding-through of additional drug portions may be prevented.

Figure 6:
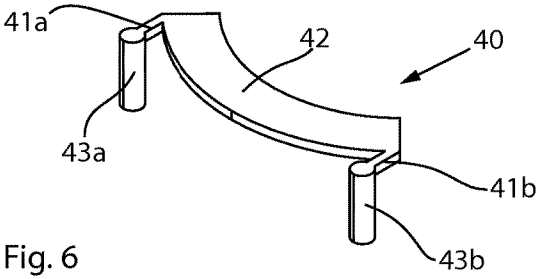
FIG. 6 is a perspective view of the restrainer of FIG. 5.

FIG. 6 shows a detailed view of the restrainer 40 having the restraining portion 42 between the first and second fastening portion components 41*a*, 41*b*, which have the respective first and second circular-cylindrical guiding portions 43*a*, 43*b* that may be guided into the respective first and second fastening sockets 15*a*, 15*b* at the circular-cylindrical section 11 of the housing 10.

Figure 7B:
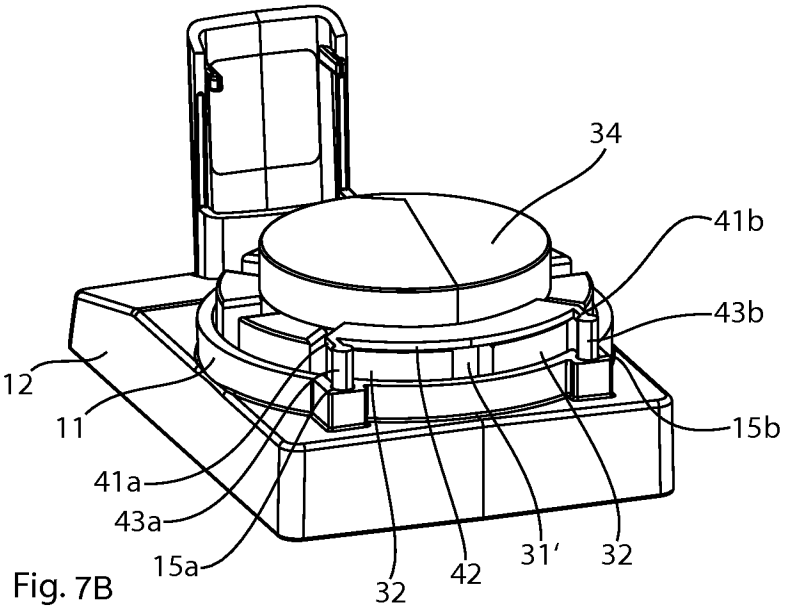
FIG. 7B is another partial cross-sectional view of the storage container of FIG. 7A.
Figure 7A:
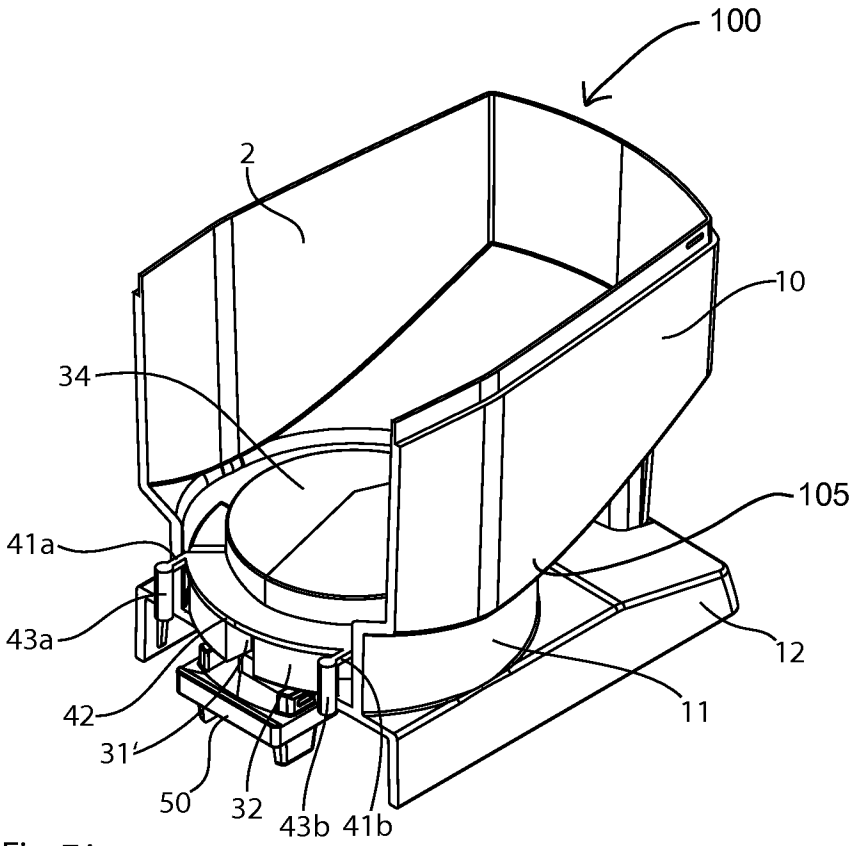
FIG. 7A is a partial cross-sectional view of an embodiment of a storage container.

FIGS. 7A and 7B show two perspective views of one or more embodiments of a storage and dispensing station 100 having a storage container 105. Here, the projections 32 may not have slots for guiding the restraining portion 42 of restrainer 40, but instead the restrainer 40 may be guided on the upper side of the projections 32. Thus, the entry of another drug portion into at least the duct 31' that is aligned with the discharge opening 21 may be prevented. The further details in regard to the fixing or placement of the restrainer 40 correspond with those of the storage and dispensing station 1 discussed above.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology.

A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

The invention claimed is:

1. A storage container for a drug storage and dispensing station, the storage container comprising:

a housing defining a receiving space for drug portions, the housing comprising:

a circular-cylindrical section having two vertical fastening sockets; and a bottom area having a discharge opening;

a singling device situated in the circular-cylindrical section of the housing, the singling device having at least one duct for receiving at least one drug portion; and a restrainer, the entirety of which is disposed completely inside of the housing, the restrainer comprising:

a fastening portion; and a restraining portion perpendicular to the fastening portion, wherein the restraining portion is positioned above the discharge opening, the restraining portion restricting additional drug portions in the receiving space from entering the at least one duct aligned with the discharge opening, and wherein the fastening portion has two fastening portion components situated at opposed outer end sections of the restraining portion, each of the fastening portion components disposed within a corresponding vertical fastening socket within the housing to fix the restrainer in the housing.

2. The storage container of claim 1, wherein the restraining portion of the restrainer is fixable in a height-adjustable manner.

3. The storage container of claim 1, wherein the at least one vertical fastening socket has a cylindrical cavity and the fastening portion has at least one circular-cylindrical guiding portion having a length, the circular-cylindrical guiding portion situated in the cylindrical cavity of the fastening socket.

4. The storage container of claim 3, wherein the cylindrical cavity is deeper than the length of the circular-cylindrical guiding portion.

5. A storage container assembly, comprising:

a housing comprising a receiving space for storing one or more drug portions, a circular-cylindrical section, a discharge opening, and a vertical cylindrical fastening socket;

a singling assembly disposed in the circular-cylindrical section and comprising a duct; and a restraining assembly disposed completely within the housing and comprising:

a fastening portion configured to engage with the vertical cylindrical fastening socket to secure the restraining assembly, wherein the fastening portion is situated in the vertical cylindrical fastening socket; and a restraining portion perpendicular to the fastening portion and configured to restrict the one or more drug portions from entering the duct when the duct is aligned with the discharge opening, wherein the restraining assembly is configured to be pushed in a direction of the discharge opening onto an upper surface of one or more projections situated near the duct.

6. The storage container assembly of claim 5, wherein the restraining portion is disposed above the discharge opening.

7. The storage container assembly of claim 5, wherein the singling assembly comprises a plurality of ducts.

8. The storage container assembly of claim 7, wherein the restraining portion is sized and shaped to block two or more of the plurality of ducts.

9. The storage container assembly of claim 7, wherein the restraining portion is configured to restrict the one or more drug portions from entering the duct aligned with the discharge opening and from entering an adjacent duct.

10. The storage container assembly of claim 5, wherein the restraining portion is adjustable.

11. The storage container assembly of claim 5, wherein the vertical cylindrical fastening socket is disposed in the circular-cylindrical section.

12. The storage container assembly of claim 5, wherein the vertical cylindrical fastening socket comprises a cylindrical cavity and the fastening portion comprises a cylindrical guiding portion disposed in the cylindrical cavity.

13. The storage container assembly of claim 5, further comprising:

first and second vertical cylindrical fastening sockets; and first and second circular-cylindrical fastening portions, wherein the first and second circular-cylindrical fastening portions are disposed within the first and second vertical cylindrical fastening sockets, respectively.

14. The storage container assembly of claim 13, wherein the first and second circular-cylindrical fastening portions are disposed on opposing ends of the restraining portion.

15. A storage container assembly of a medication storage and dispensing station, comprising:

a housing, the housing comprising:

a receiving space for storing a plurality of the same type of medication, wherein the medication is one of pills, tablets, capsules and gel-caps;

a circular-cylindrical section;

a discharge opening disposed at the bottom of the circular-cylindrical section; and first and second vertical cylindrical fastening sockets;

a singling assembly disposed in the circular-cylindrical section and comprising a plurality of ducts; and an integrally formed restraining assembly, the integrally formed restraining assembly comprising:

first and second vertical cylindrical fastening portions slidingly engaged with the first and second vertical cylindrical fastening sockets respectively to secure the restraining assembly to the housing, the integrally formed restraining assembly is configured to be pushed in a direction of the discharge opening onto an upper surface of one or more projections situated near at least one duct of plurality of ducts; and a restraining portion angled from the fastening portion, the restraining portion disposed over the discharge opening and configured to restrict any medication from entering a duct aligned with the discharge opening.

16. The storage container of claim 1, wherein the restrainer is configured to be pushed in a direction of the discharge opening onto an upper surface of one or more projections situated near the at least one duct.

* * * * *